US005887371A

United States Patent [19]

Curley, Jr.

[11] Patent Number: 5,887,371

[45] **Date of Patent: *Mar. 30, 1999**

[54] FOOTWEAR CLEAT

[76] Inventor: John J. Curley, Jr., P.O. Box 442, Tyngsboro, Mass. 01879

[ * ] Notice: This patent issued on a continued prosecution application filed under 37 CFR 1.53(d), and is subject to the twenty year patent term provisions of 35 U.S.C. 154(a)(2).

[21] Appl. No.: 800,580

[22] Filed: Feb. 18, 1997

[51] Int. Cl.[6] ..... A43B 5/00; A43C 15/02

[52] U.S. Cl. ..... 36/127; 36/134; 36/59 C

[58] Field of Search ..... 36/127, 134, 59 R, 36/59 C, 59 A, 59 B, 67 R, 67 A, 67 C, 67 D

[56] References Cited

U.S. PATENT DOCUMENTS

| | | | |
|---|---|---|---|
| 180,578 | 8/1876 | Gunsalus | 36/59 R |
| 697,135 | 4/1902 | Dearing | 36/59 R |
| 1,768,426 | 6/1930 | Stelzer . | |
| 1,827,514 | 10/1931 | Golden | 36/67 D X |
| 2,185,397 | 1/1940 | Birchfield | 36/59 R |
| 2,213,289 | 9/1940 | Riddell | 36/59 R |
| 2,223,794 | 12/1940 | Pierce et al. | 36/59 R |
| 2,276,887 | 3/1942 | Smith | 36/59 |
| 2,292,299 | 8/1942 | Smith | 36/59 |
| 2,423,753 | 7/1947 | Brooks | 36/59 A X |
| 2,740,208 | 4/1956 | Dye | 36/59 R |
| 2,774,151 | 12/1956 | Dahlquist et al. . | |
| 2,784,503 | 3/1957 | Anderson | 36/59 |
| 3,328,901 | 7/1967 | Stickland | 36/59 R |
| 3,512,275 | 5/1970 | Leavitt | 36/59 R |
| 3,583,082 | 6/1971 | Jordon, Jr. | 36/59 R |
| 3,775,874 | 12/1973 | Bonneville | 36/67 D |
| 4,118,878 | 10/1978 | Semon | 36/59 C |
| 4,205,466 | 6/1980 | Collins | 36/67 D |
| 4,360,490 | 11/1982 | Collins | 264/249 |
| 4,375,728 | 3/1983 | Dassler | 36/59 C X |
| 4,587,748 | 5/1986 | Collins | 36/127 |
| 4,648,187 | 3/1987 | Dassler et al. | 36/134 |
| 4,723,366 | 2/1988 | Hagger | 36/134 |
| 5,029,405 | 7/1991 | DeHaitre | 36/134 |
| 5,259,129 | 11/1993 | Deacon et al. | 36/127 |
| 5,367,793 | 11/1994 | Deacon et al. | 36/127 |
| 5,410,823 | 5/1995 | Iyoob . | |
| 5,426,873 | 6/1995 | Savoie | 36/127 |
| 5,524,367 | 6/1996 | Ferreira et al. | 36/134 |

FOREIGN PATENT DOCUMENTS

| | | | |
|---|---|---|---|
| 109770 | 5/1928 | Austria | 36/59 R |
| 0 282 257 | 9/1988 | European Pat. Off. . | |
| 536202 | 4/1922 | France | 36/67 A |
| 670800 | 7/1989 | Switzerland | 36/59 R |
| 1139239 | 1/1969 | United Kingdom | 36/67 A |
| 1 564 903 | 4/1980 | United Kingdom . | |
| 2 160 146 | 12/1985 | United Kingdom . | |
| 2 163 037 | 2/1986 | United Kingdom . | |
| 2 191 079 | 12/1987 | United Kingdom . | |

OTHER PUBLICATIONS

Advertisement, "Introducing Gripper™ Golf Cleats", at least by Feb., 1997.

Advertisement for Softspikes (1996).

"Retail Report—Big Step for Softspikes," at least by Nov. 5, 1996.

Purkey, M., "The Spikeless Debate," at least by Feb., 1996.

"#10 Soft Spikes," *Golf World,* p. 65, 1996 Annual Issue.

*Primary Examiner*—Ted Kavanaugh
*Attorney, Agent, or Firm*—Hamilton, Brook, Smith & Reynolds, P.C.

[57] ABSTRACT

A footwear cleat of flexible plastic includes a central hub portion and a series of resilient protrusions cantilevered from and extending radially outward and downwardly beyond the central hub portion. The protrusions are capable of horizontally engaging turf under the footwear for providing secure footing.

14 Claims, 7 Drawing Sheets

FOOTWEAR CLEAT

BACKGROUND

Athletic shoes for use in sporting activities often employ spikes protruding from the soles of the shoes for better traction. Referring to FIG. 1, golf shoes such as shoe 60 traditionally have a series of individual spikes 62 protruding from the sole 60*a* which extend downwardly about 8 mm from respective base flanges 64 mounted to the sole 60*a*. Spikes 62 are long enough to penetrate into the soil 36 to provide traction. Recently, golf courses have begun to prohibit the use of these traditional golf spikes due to the damage they cause to the turf, particularly to golf course greens.

The response of golf spike manufacturers to the prohibition of traditional spikes is to position a series of small protrusions 66 approximately 2 mm high in a circular pattern on a traditional spike base flange 64 as seen in FIG. 2. A drawback of this approach is that little ground engaging ability is provided particularly on wet surfaces resulting in sub-standard support and protection for the golfer.

SUMMARY OF THE INVENTION

The present invention is directed to cleats for footwear such as golf shoes which provide support similar to traditional spikes while at the same time do not damage turf such as golf course greens. The present invention footwear cleat includes a central hub portion and a series of protrusions or projections cantilevered from and extending radially outward from the hub portion for engaging turf.

In preferred embodiments, the protrusions also extend slightly downwardly beyond the hub portion. When the cleat is secured to a footwear sole, the protrusions are spaced away from the footwear sole. The cleat is formed from flexible plastic so that the protrusions are resilient and are capable of deflecting upwardly. The protrusions are curved with a first convex edge and a second concave edge and the second edge is preferably shorter than the first edge. A threaded portion extends from the central hub portion for securing the cleat to footwear.

While traditional spikes are designed to penetrate turf, the cleat of the present invention is not adapted to provide traction between the footwear and the turf by penetrating the turf. Should a user of the present cleat invention cleat start to slip in any direction on a fairway or in a rough area with a hilly surface, the protrusions snare strands of turf above the soil, trapping some grass in the area between the protrusions and the sole of the footwear. However, when walking on a relatively flat, firm surface such as golf greens, the weight of the user causes the protrusions to deflect or fold upwardly retracting the protrusions from engagement with the turf. This renders the cleats dormant and prevents damage to surfaces such as golf greens. Most golf greens are relatively flat surfaces so that traction is generally not needed and there is little chance of slipping while walking without traction. An additional benefit of the present cleat invention is that footwear including the cleats can be worn indoors without damaging the flooring due to the soft plastic material of the cleats and the fact that the cleat protrusions become inactivated or detented when pressed upon the flooring.

DESCRIPTION OF PREFERRED EMBODIMENTS

Figure 1:
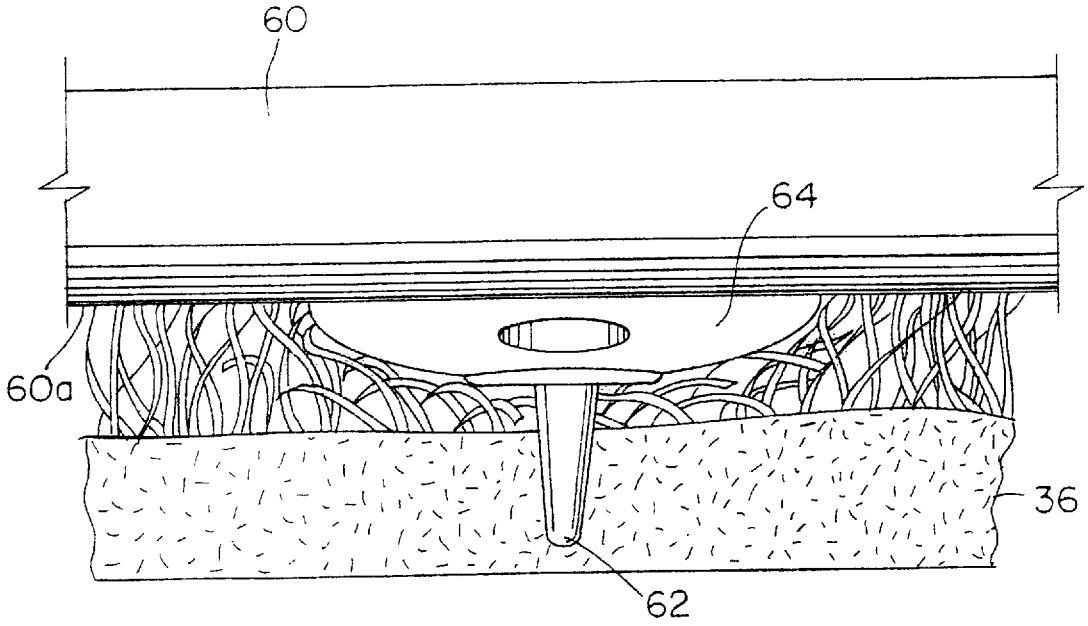
FIG. 1 PRIOR ART
FIG. 1 is a side view of a traditional prior art metal spike in a section of dense short turf such as a golf green.
Figure 2:
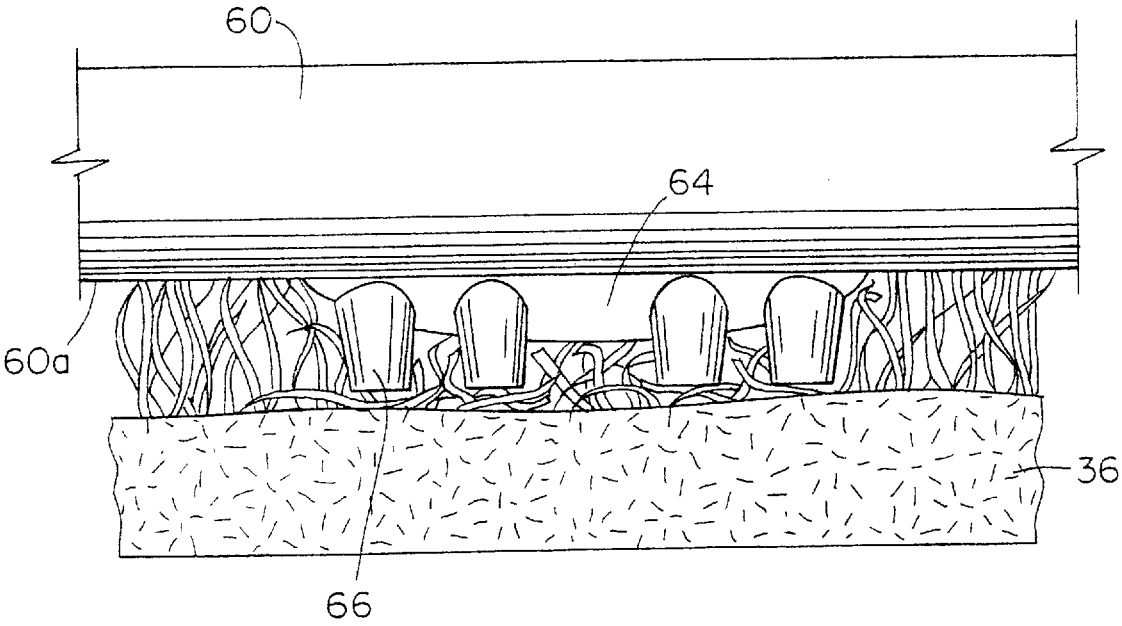
FIG. 2 PRIOR ART
FIG. 2 is a side view of a prior art spike consisting of a series of small protrusions in a section of dense short turf.
Figure 3:
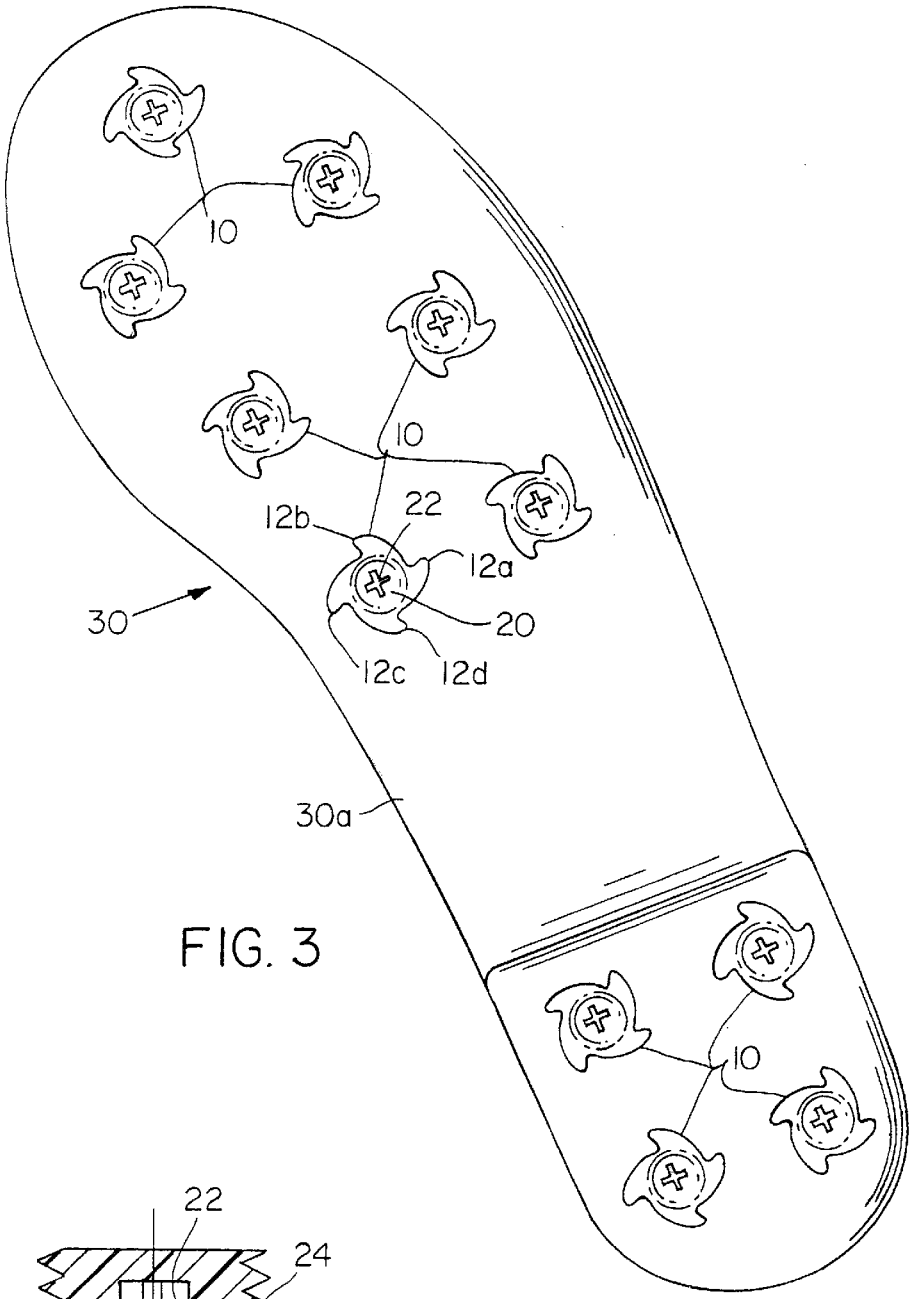
FIG. 3 is a bottom view of a golf shoe including the present invention cleats.
Figure 6:
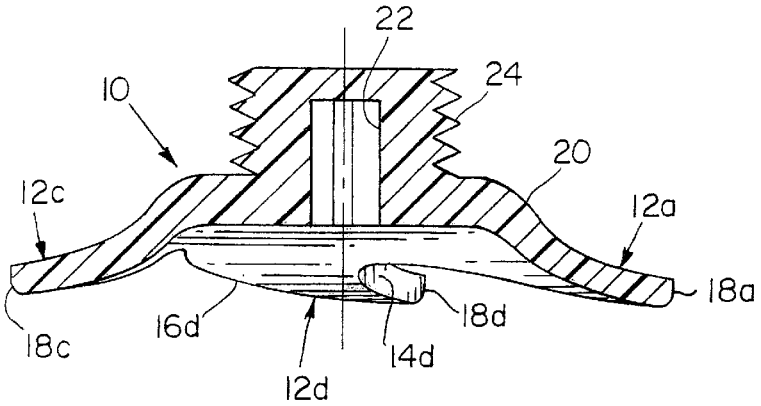
FIG. 6 is a side sectional view of the present invention cleat.
Figure 4:
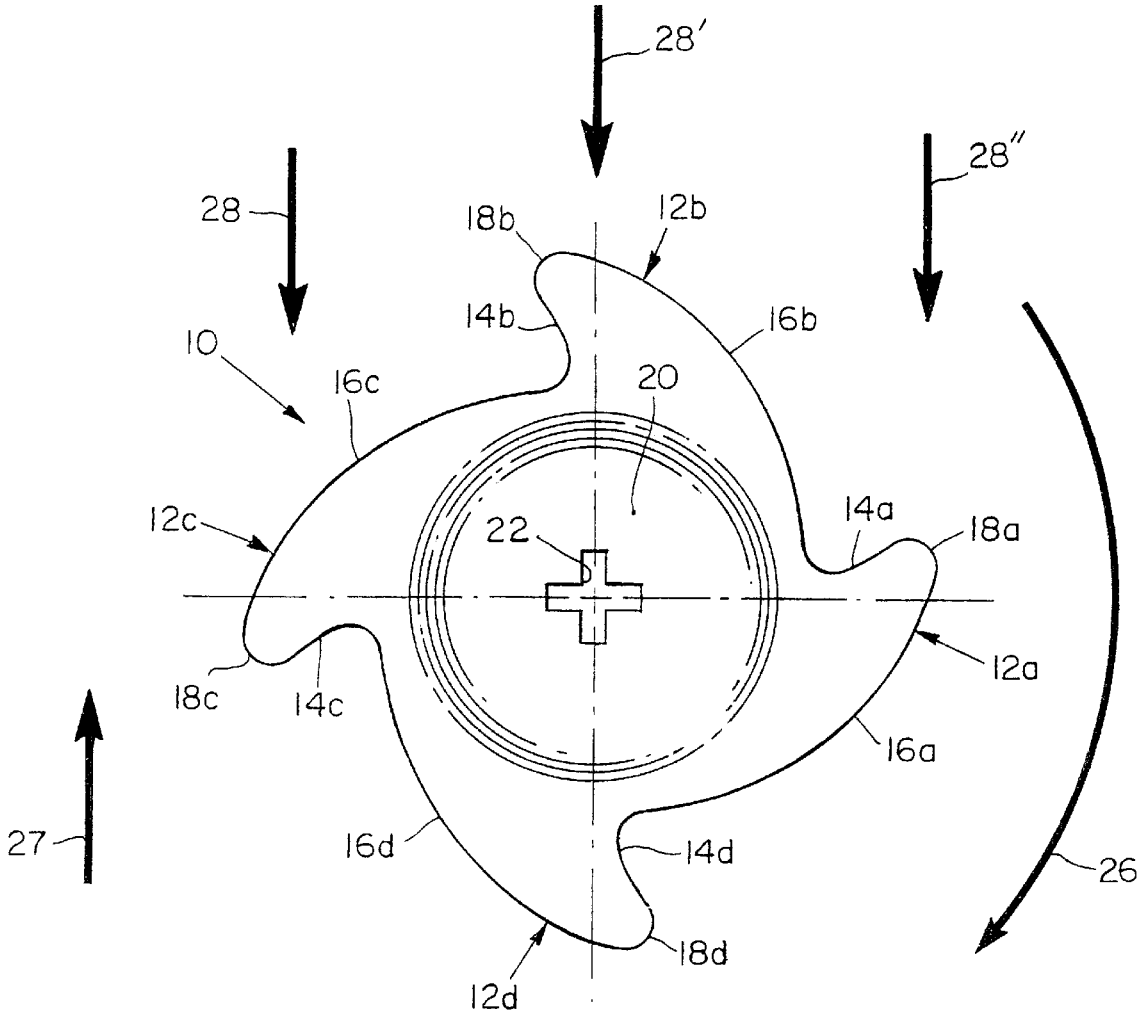
FIG. 4 is a bottom view of the present invention cleat.

Referring to FIGS. 3, 4, 5 and 6 golf shoe 30 includes a series of the present invention cleats 10 mounted to the sole 30*a* of golf shoe 30. Each cleat 10 includes a plurality of turf engaging protrusions 12*a*, 12*b*, 12*c* and 12*d* extending radially outwardly and curving downwardly beyond a central hub portion 20. Each turf engaging element 12*a*, 12*b*, 12*c* and 12*d* has a respective first curved convex edge 16*a*, 16*b*, 16*c* and 16*d* as well as a respective second curved concave edge 14*a*, 14*b*, 14*c* and 14*d*. The curved convex edges 16*a*, 16*b*, 16*c* and 16*d* are longer than the curved concave edges 14*a*, 14*b*, 14*c* and 14*d*. This results in tips 18*a*, 18*b*, 18*c*, and 18*d* spiraling outward from and beyond central hub portion 20. Preferably, the curved convex edges 16*a*, 16*b*, 16*c* and 16*d* are more than 3 times longer than the curved concave edges 14*a*, 14*b*, 14*c* and 14*d*. The turf engaging protrusions 12*a*, 12*b*, 12*c* and 12*d* are cantilevered from central hub portion 20. The downward curve of turf engaging protrusions 12*a*, 12*b*, 12*c* and 12*d* begins to curve outwardly near tips 18*a*, 18*b*, 18*c* and 18*d* such that the tips are substantially horizontal and parallel to sole 30*a*. A circular gap 34 is formed around the circumference of central hub portion 20 between sole 30*a* and turf engaging protrusions 12*a*, 12*b*, 12*c* and 12*d* (FIG. 7) due to the radially outward and downward extension of the turf engaging protrusions 12*a*, 12*b*, 12*c* and 12*d* from central hub portion 20.

Figure 5:
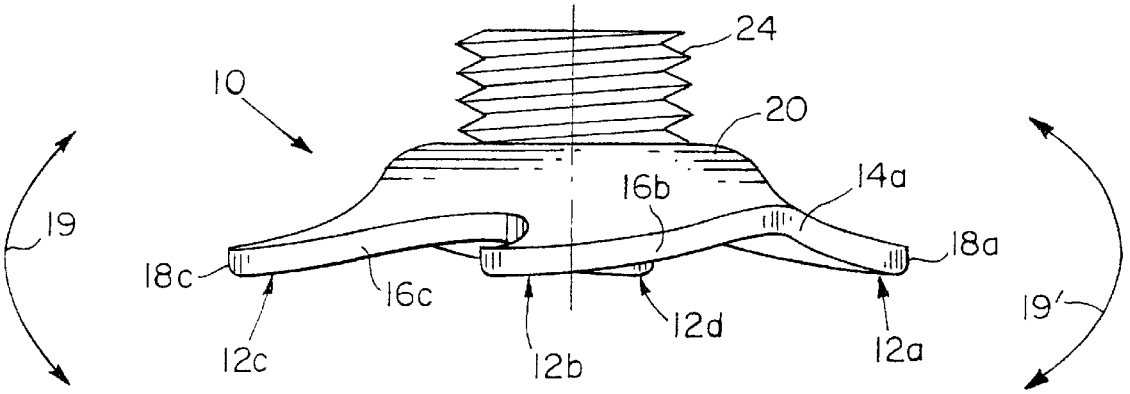
FIG. 5 is a side view of the present invention cleat.

Cleat 10 is preferably molded from a pliable soft plastic material such as 40 durometer thermal plastic urethane so that turf engaging protrusions 12*a*, 12*b*, 12*c*, and 12*d* are flexible. For example, as seen in FIG. 5, turf engaging protrusions 12*a* and 12*c* are flexible along arcs 19' and 19 respectively. This allows turf engaging protrusions 12*a*, 12*b*, 12*c* and 12*d* to fold or deflect upwardly or downwardly. The turf engaging protrusions 12*a*, 12*b*, 12*c* and 12*d* fold upwardly when sufficient weight is applied onto cleats 10 as the user is walking on a relatively flat firm surface such as a golf green. The flexibility of the turf engaging protrusions 12*a*, 12*b*, 12*c* and 12*d* can be controlled by material selection. For example, softer materials resulting in more flexible protrusions 12*a*, 12*b*, 12*c* and 12*d* can be employed for cleats 10 for users that are light in weight such as children.

The central hub portion 20 of each cleat 10 has a threaded portion 24 for attaching cleat 10 to a corresponding mating threaded hole in sole 30*a*. A cross-shaped hole 22 is formed in central hub portion 20 and extends upwardly into the core of threaded portion 24. The cross-shaped hole 22 accepts a phillips head screwdriver for tightening cleat 10 to sole 30*a*.

Figure 7:
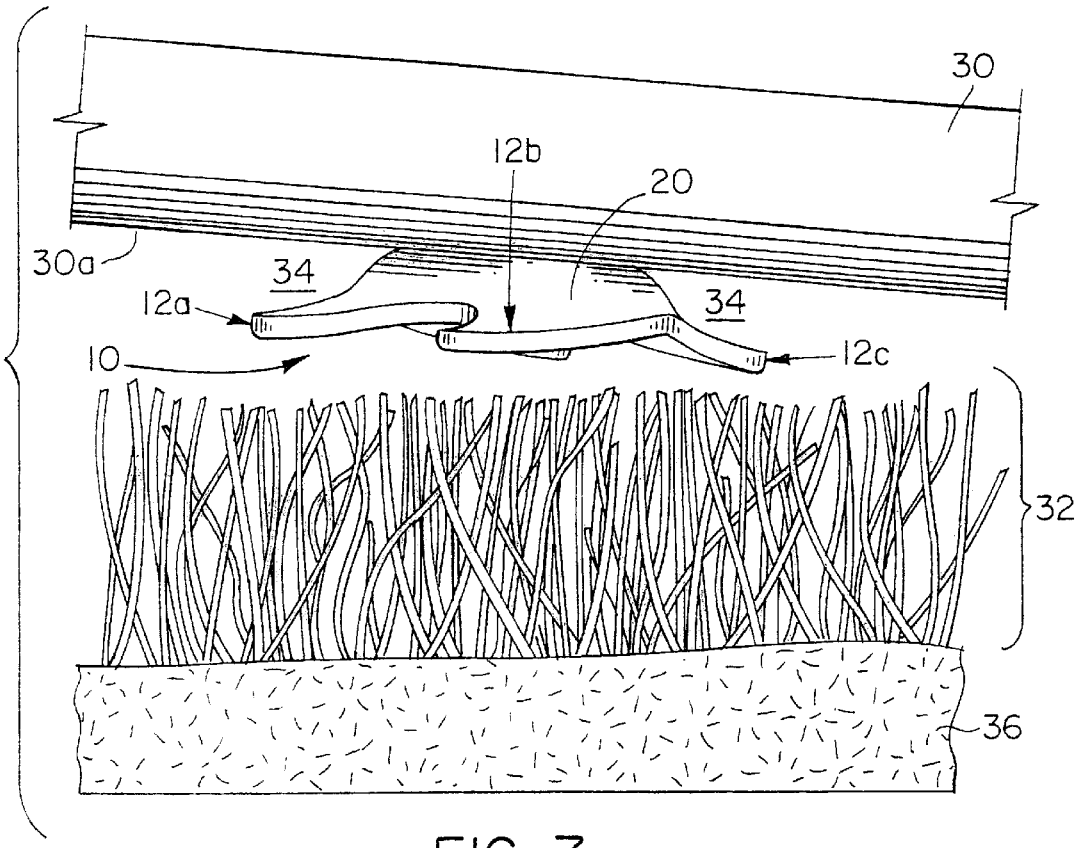
FIG. 7 is a side view of the present invention cleat on the bottom of a shoe positioned over a section of turf.
Figure 8:
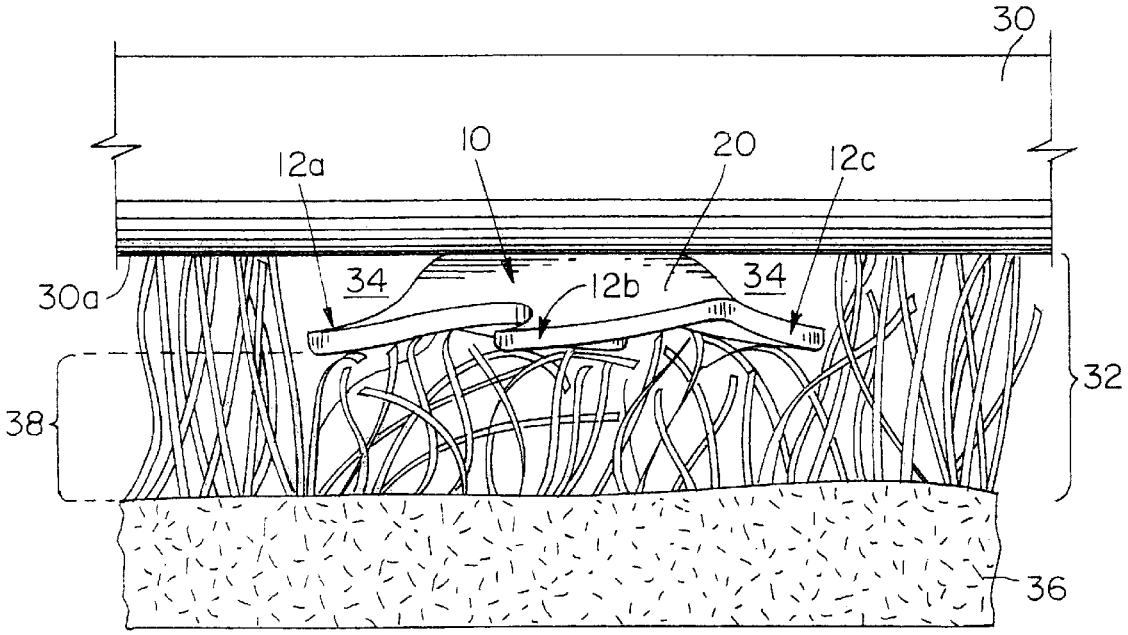
FIG. 8 is a side view of the cleat within the section of turf.
Figure 9:
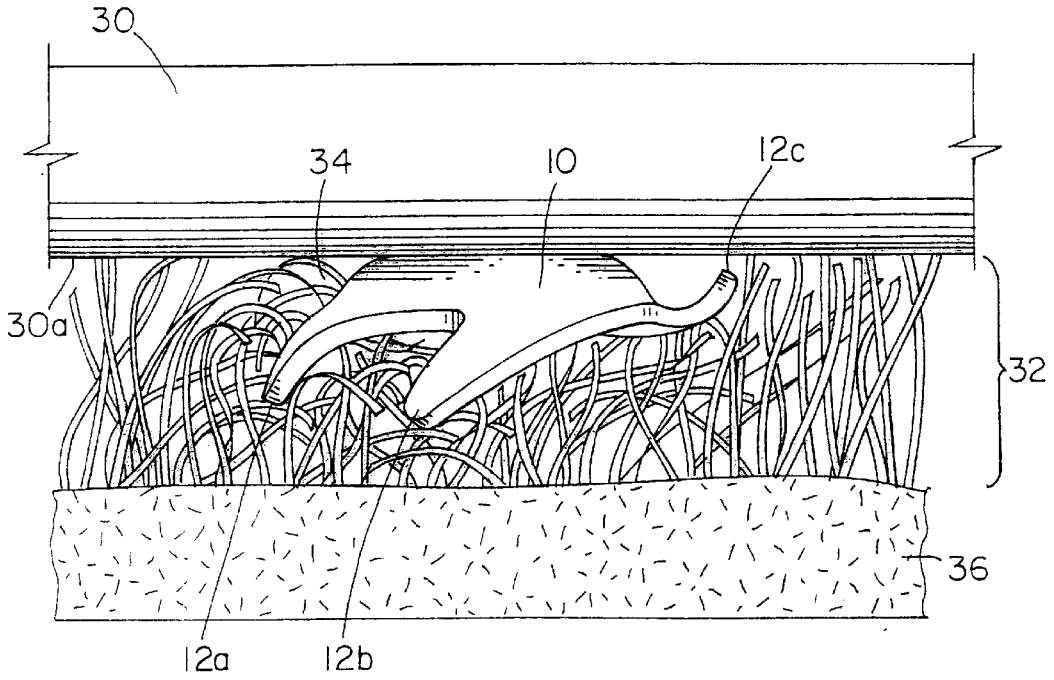
FIG. 9 is a side view of the cleat with the turf engaging protrusions engaging the section of turf.

FIGS. 7, 8 and 9 depict the operation of a single cleat 10 when a user wearing golf shoes 30 walks over a turf region 32 such as a fairway. In FIG. 7, at the beginning of a step, golf shoe 30 and cleat 10 are suspended over turf 32 and soil 36. Turf engaging protrusions 12*a*, 12*b*, 12*c* and 12*d* of cleat 10 are oriented as originally molded.

In FIG. 8, golf shoe 30 is set down on turf 32 and soil 36. An area of turf 38 is compacted underneath cleat 10. On a typical fairway, the turf 32 has a high loft and turf engaging protrusions 12*a*, 12*b*, 12*c*, and 12*d* remain in their molded position. The circular gap 34 remains open as the pressure against the compacted turf 38 is not sufficient to fold or deflect the turf engaging protrusions 12*a*, 12*b*, 12*c* and 12*d* upwardly.

Referring to FIG. 9, when golf shoe 30 and cleat 10 slip along the turf in the direction of arrow 27 (FIG. 4), turf engaging protrusions 12*a* and 12*b* become tangled in turf 32 and fold downwardly causing golf shoe 30 to stop slipping in the direction of arrow 27. Circular gap 34 fills with turf further forcing turf engaging protrusions 12*a* and 12*b* downwardly. Turf engaging protrusion 12*d* (not visible), tends not to tangle within the turf because the attacking edge is the convex edge 16*d* against which the turf slides. As a result, turf engaging protrusion 12*d* tends to fold upwardly into circular gap 34. Turf engaging element 12*c* also tends to fold upwardly into circular gap 34.

The longer convex edges 16*a*, 16*b*, 16*c* and 16*d* in combination with the shorter concave edges 14*a*, 14*b*, 14*c* and 14*d* facilitates self tightening of cleat 10 during use. Arrow 26 (FIG. 4) designates the direction in which cleat 10 is screwed into sole 30*a*. Should cleat 10 slip in the direction of arrow 27, resistance by the turf would be applied equally from a direction indicated by arrows 28, 28' and 28". The turf grabs the short concave surface of edge 14*a* on turf engaging protrusion 12*a*. At the same time the turf slides around the long convex edge 16*c* of turf engaging protrusion 12*c* such that turf engaging protrusion 12*c* is not grabbed with as much force as turf engaging protrusion 12*a*. This means that the net result of the applied forces tightens cleat 10 in the direction of arrow 26 rather than loosening the cleat 10.

Figure 10:
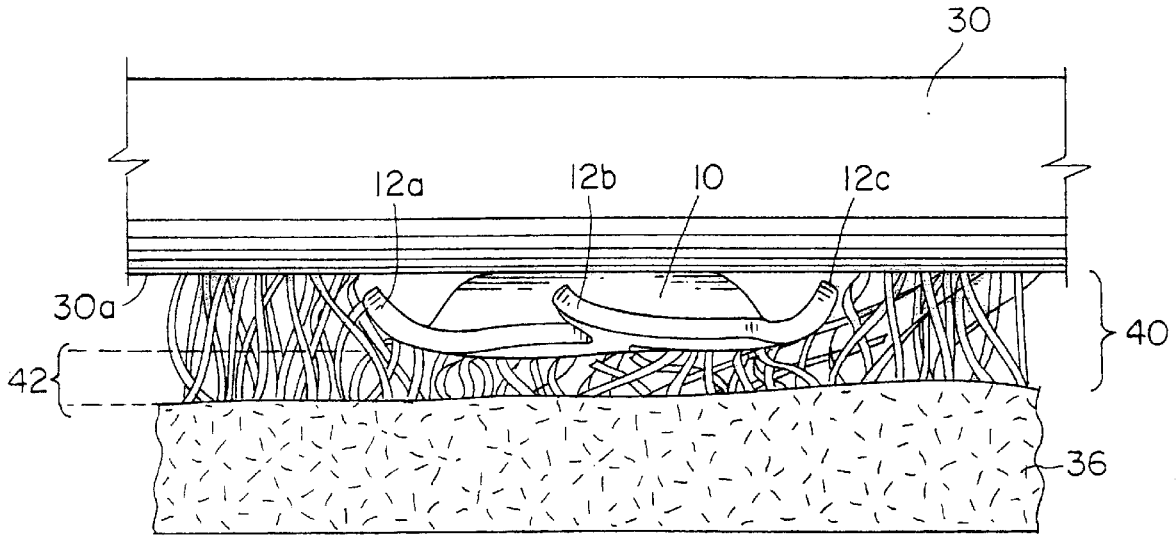
FIG. 10 is a side view of the cleat with the turf engaging protrusions in the compressed position on a section of dense short turf such as a golf green.

FIG. 10 depicts the operation of cleat 10 when walking on a section of dense short turf 40 such as a golf green. A region of turf 42 under cleat 10 is compacted by cleat 10. Turf engaging protrusions 12*a*, 12*b*, 12*c* and 12*d* are folded or deflected upwardly by the relatively firm surface of the golf green and do not engage turf 40, thereby preventing damage to the golf green. The turf engaging protrusions also fold upwardly when walking on solid surfaces such as on asphalt or indoor flooring and will not damage such surfaces.

Figure 11:
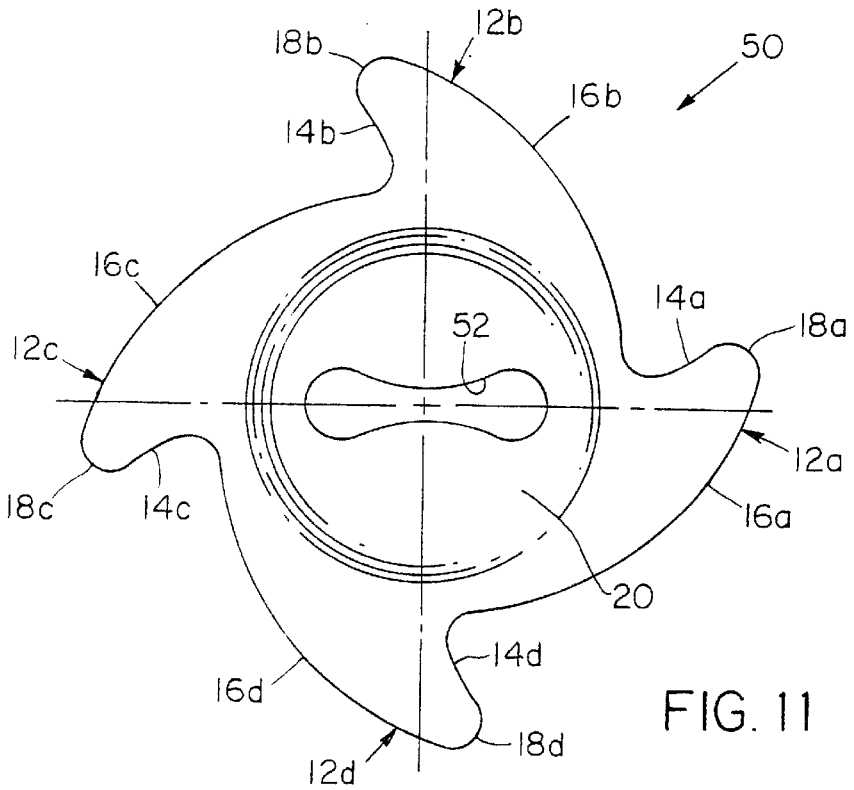
FIG. 11 is a bottom view of another preferred cleat.

FIG. 11 depicts another preferred cleat 50 which differs from cleat 10 in that cleat 50 includes a slot 52 for tightening cleat 50 onto the sole 30*a* of shoe golf 30 with a screw driver. Slot 52 can be made large enough to be tightened with the edge of a coin such as a dime.

Figure 12:
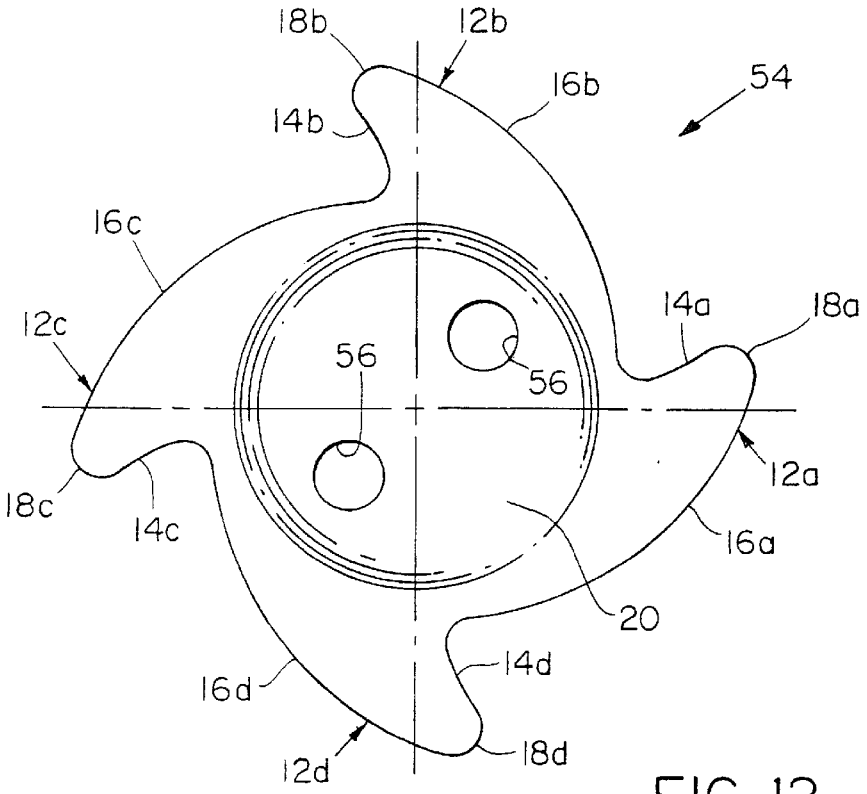
FIG. 12 is a bottom view of still another preferred cleat.

FIG. 12 depicts still another preferred cleat 54 which differs from cleat 10 in that cleat 54 includes two holes 56 for tightening cleat 54 onto sole 30*a* of golf shoe 30. A tool having two protrusions mating with holes 56 is used for tightening cleat 54.

Figure 13:
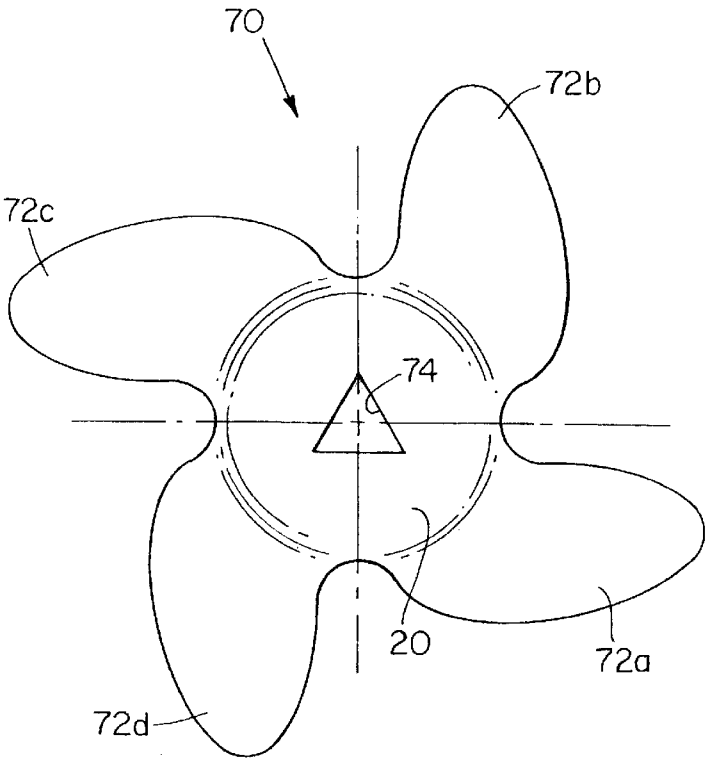
FIG. 13 is a bottom view of yet another preferred cleat.

FIG. 13 depicts yet another preferred cleat 70 which differs from cleat 10 in that engaging protrusions 72*a*, 72*b*, 72*c*, and 72*d* are wider and extend from hub portion 20 substantially perpendicular to each other. In addition, cleat 70 includes a triangular hole 74 for tightening cleat 70 with a triangular shaped tool.

Figure 14:
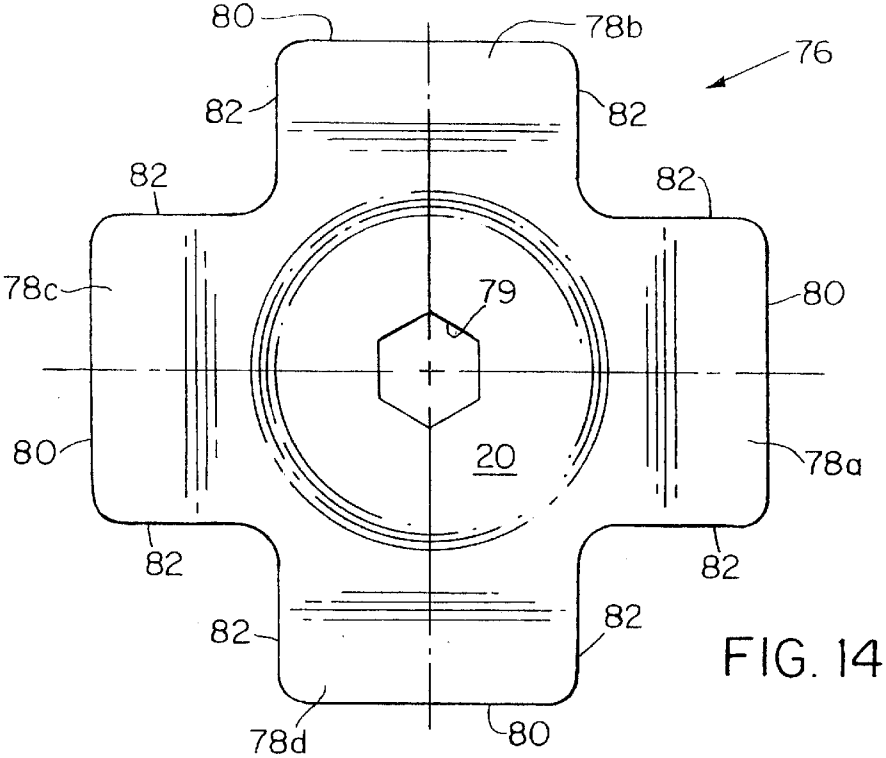
FIG. 14 is a bottom view of still another preferred cleat.
Figure 15:
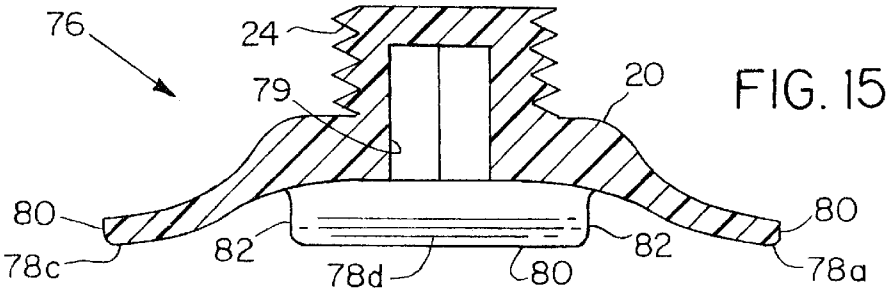
FIG. 15 is a side sectional view of the cleat shown in FIG. 14.

FIGS. 14 and 15 depict another preferred cleat 76 which differs from cleat 10 in that turf engaging protrusions 78*a*, 78*b*, 78*c* and 78*d* have parallel edges 82 and flat tips 80 so that the turf engaging protrusions 78*a*, 78*b*, 78*c* and 78*d* extend outwardly and downwardly beyond the hub in a relatively straight manner instead of spiraling outwardly. In addition, cleat 76 includes a hexagonal hole 79 for tightening cleat 76 with a hexagonal wrench.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. For example, holes having other suitable shapes such as square holes or star-shaped holes can be formed in the present invention cleats for accommodating other common types of driving tools. In addition, although the present invention cleats have been described for providing traction for golf shoes, alternatively, the use of the cleats is not limited to golf shoes but can be employed for other suitable purposes such as soccer or football as well as surfaces other than grass. Furthermore, although each preferred cleat has been depicted with four protrusions, alternatively, more than four or less than four protrusions can be employed.

What is claimed is:

1. A footwear cleat for securing to a footwear sole for use on turf comprising:

a central hub portion; and a resilient portion extending radially outward and downward from and beyond the hub portion until terminating in substantially flat tips, the tips extending outwardly and substantially parallel to the footwear sole so as not to engage and damage the turf as the footwear sole is presented to the turf, the tips deflecting upwardly to further avoid damage to the turf when traction is not needed, connecting edges being formed between adjacent tips, the tips deflecting downward so that the connecting edges and tips engage upper layers of the turf and provide traction when the cleat begins to slip laterally on the turf.

2. The cleat of claim 1 in which the tips are curved.

3. The cleat of claim 2 in which each tip has a first edge and second edge, the second edge being shorter than the first edge.

4. The cleat of claim 3 in which the first edge has a convex curve and the second edge has a concave curve.

5. The cleat of claim 1 in which the cleat is formed from flexible plastic.

6. The cleat of claim 1 further comprising a threaded portion extending from the central hub portion for securing the cleat to footwear.

7. The cleat of claim 1 in which the tips are spaced away from the footwear sole when secured thereon.

8. The cleat of claim 1 in which the cleat is of integral construction.

9. A method of forming a footwear cleat for securing to a footwear sole for use on turf comprising the steps of:

providing a central hub portion; and extending a resilient portion radially outward and downward from and beyond the hub portion until terminating in substantially flat tips, the tips extending outwardly and substantially parallel to the footwear sole so as not to engage and damage the turf as the footwear sole is presented to the turf, the tips deflecting upwardly to further avoid damage to the turf when traction is not needed, connecting edges being formed between adjacent tips, the tips deflecting downward so that the connecting edges and tips engage upper layers of the turf and provide traction when the cleat begins to slip laterally on the turf.

10. The method of claim 9 further comprising the step of curving the tips such that each tip has a convex first edge and a convex second edge, the second edge being shorter than the first edge.

11. The method of claim 9 further comprising the step of forming the tips from flexible plastic such that the tips are capable of deflecting upwardly.

12. A method of providing secure footing for footwear with a cleat on turf, the footwear having a bottom, the cleat having a central hub portion secured to the bottom of the footwear and a resilient portion extending radially outward and downward from and beyond the hub portion until terminating in substantially flat tips, the tips extending outwardly and substantially parallel to the footwear bottom so as not to engage and damage the turf as the footwear bottom is presented to the turf, connecting edges being formed between adjacent tips for engaging the turf between the tips, the method comprising the step of horizontally engaging upper layers of the turf under the footwear with the tips and connecting edges for preventing the footwear from slipping by trapping turf in the protrusions, the tips deflecting downward when the cleat begins to slip laterally on the turf.

13. The method of claim 12 further comprising the step of trapping turf between the bottom of the footwear and the tips.

14. The method of claim 12 in which the step of horizontally engaging turf comprises snaring grass strands with the tips.

* * * * *